US005374299A

United States Patent [19]

Bodenstein et al.

[11] Patent Number: 5,374,299

[45] Date of Patent: Dec. 20, 1994

[54] PYROMETALLURGICAL PROCESS FOR TREATING A FEED MATERIAL

[75] Inventors: Johannes J. Bodenstein, Delmas; Krause L. Ehlers, Johannesburg; Kevin P. D. Perry, Randburg, all of South Africa

[73] Assignee: Johannesburg Consolidated Investment Company Limited, Johannesburg, South Africa

[21] Appl. No.: 149,028

[22] Filed: Nov. 8, 1993

Related U.S. Application Data

[63] Continuation of Ser. No. 914,883, Jul. 16, 1992, abandoned, which is a continuation of Ser. No. 766,007, Sep. 26, 1991, abandoned.

[51] Int. Cl.[5] ..... C22B 5/00

[52] U.S. Cl. ..... 75/707; 75/645; 266/216; 266/222; 266/227

[58] Field of Search ..... 75/707, 645; 266/216, 266/222, 227

[56] References Cited

U.S. PATENT DOCUMENTS

| | | | |
|---|---|---|---|
| 3,462,263 | 8/1969 | Walsch et al. . | |
| 3,664,828 | 5/1972 | Worner | 75/645 |
| 3,823,012 | 7/1974 | Johnstone | 266/221 |
| 4,251,271 | 2/1981 | Floyd . | |
| 4,639,269 | 1/1987 | Hilbrans | 266/225 |

FOREIGN PATENT DOCUMENTS

| | | |
|---|---|---|
| 520351 | 1/1982 | Australia . |
| 0199441 | 10/1986 | European Pat. Off. . |
| 0355163 | 2/1990 | European Pat. Off. . |
| 1257877 | 2/1961 | France . |
| 2293494 | 7/1976 | France . |
| 1931867 | 1/1970 | Germany . |
| 62-188713 | 2/1986 | Japan . |
| 01290721 | 2/1990 | Japan . |
| 1218388 | 1/1971 | United Kingdom . |
| 1474357 | 5/1977 | United Kingdom . |
| 1599366 | 9/1981 | United Kingdom . |

OTHER PUBLICATIONS

Floyd, J. M., "Metallurgical Applications Of High Temperature Submerged Combustion," Institute Of Fuels Conference, Adelaide, Nov. 1974, 15 pages.

Floyd, J. M., et al., "Developments In The Pyrometallurgical Treatment Of Slag: A Review Of Current Technology And Physical Chemistry," Extraction Metallurgy, 1981, IMM, 1981, pp. 345–371.

Floyd, J. M., et al., "Smelting Opportunities With Sirosmelt Technology," 113th AIME Annual Meeting, Los Angeles, Feb. 26 to Mar. 1, 1984, 15 pages.

Floyd, J. M., et al., "Sirosmelt And The Wide World of Opportunity," Engineering And Mining Journal, Jun. 1985, pp. 52–56.

Floyd, J. M., et al., "Coal As A Fuel And Reductant In Sirosmelt Furnaces," Coal Power '87, AusIMM Annual Conference, Newcastle, NSW, May 1987, pp. 95–99.

Foo, K. A., et al, "Operation Of A 4 T/H Matte-Fuming Pilot Plant," Pyrometallurgy '87, Institution Of Mining And Metallurgy (IMM), London, Sep. 1987, pp. 389–418.

(List continued on next page.)

*Primary Examiner*—Peter D. Rosenberg
*Attorney, Agent, or Firm*—John P. White

[57] ABSTRACT

A process of pyrometallurgically treating a feed material such as a sulphide ore or concentrate is provided. The process includes the steps of:

(a) producing a liquid body of feed material;

(b) creating a first reaction zone and a second reaction zone which is in contact with the first reaction zone and is in the liquid body;

(c) introducing feed material in particulate form and an oxidising gas into the first reaction zone;

(d) allowing in-flight oxidation of feed material to take place in the first reaction zone;

(e) allowing at least some of the reaction products of the in-flight oxidation to pass into a second reaction zone; and (f) allowing sulphidation or reduction of the reaction products to take place in the second reaction zone.

14 Claims, 2 Drawing Sheets

OTHER PUBLICATIONS

Floyd, J. M., "Bath Smelting Of Base Metals," Technological Advances In Extractive Metallurgy Conference, Lulea, Sweden, Sep. 1988, 25 pages.

Floyd, J. M., et al., "Sirosmelt Technology Opens Up New Opportunities In Base And Precious Metal Production," Paper to the United Nations Lead Zinc Study Group, Vienna, 1989, 26 pages.

Gupta, S. K., et al, "Direct Smelting Of Zinc," DGM Conference, Cologne, 1989, 16 pages.

Nagano, T., et al., "Commercial Operation Of Mitsubishi Continuous Copper Smelting And Converting Process," International Symposium On Copper Extraction And Refining, Las Vegas, Nev., Feb. 1976, Yannopoulos, J. C., et al., organizing committee co chairman, pp. 439–457.

Sweetin, R. M., et al., "The Kidd Smelter, Startup And Early Operation," Advances In Sulfide Smelting, Proceedings Of The 1983 International Sulfide Smelting Symposium And the 1983 Extractive And Process Metallurgy Meeting Of The Metallurgical Society Of AIME held in San Francisco, Calif., Nov. 1983, Sohn, H. Y., et al., editors, pp. 789–815.

Kemori, N., et al., "Reaction Mechanism In A Copper Flash Smelting Furnace," Metallurgical Transactions B, vol. 20B, Jun. 1989, pp. 327–336.

Jorgensen, F. R. A., "Single Particle Combustion Of Chalcopyrite," reprinted from Proc. Australas. Inst. Metall., No. 288: 37–46, Dec. 1983, pp. 37–46, published by the Australasian Institute Of Mining and Metallurgy, Australia.

Ruehl, B., et al., "The Flame Cyclone Technology And Its Possible Application," The Reinhardt Schuhmann International Symposium On Innovative Technology And Reactor Design In Extraction Metallurgy, held at TMS-AIME Fall Meeting for Extractive And Process Metallurgy, Colorado Springs, Colo., Nov. 1986, Gaskell, D., R., et al., editors, published by Metallurgical Society, Inc., pp. 175–194.

Partelpoeg, E. H., "Flash Smelting Reactions At The Phelps Dodge Hidalgo Smelter," Flash Reaction Processes, Robertson, D. G. C. et al., editors, published by the Center For Pyrometallurgy, Fulton Hall, University Of Missouri, Rolla Conference held University of Utah, Jun. 1988, pp. 35–45.

Henley, R. G., et al., "Suspension Smelting Studies On Mount ISA Copper Concentrate," 1983 Fall Extractive And Process Metallurgy Meeting Of The Metallurgical Society Of AIME And 1983 International Sulfide Smelting Symposium, Richards., K. J., Honorary Chairman, published by the Metallurgical Society Of AIME, Warrendale, Pa., 1983, pp. 81–98.

Kim, Y. H., et al., "Effect Of Phase Transformation And Particle Fragmentation On The Flash Reaction Of Complex Metal Sulfides," The Reinhardt Schuhmann International Symposium On Innovative Technology And Reactor Design In Extraction Metallurgy, held at the TMS–AIME Fall Meeting for Extractive And Process Metallurgy, Colorado Springs, Colo., Nov. 1986, Gaskell, D. R., et al., editors, published by the Metallurgical Society, Inc., pp. 349–369.

Evans, J. W., et al., "Process Dynamics: Gas/Solid," Proceedings Of The Elliott Symposium On Chemical Process Metallurgy, Cambridge, Mass., Jun. 1990, Koros, P. J., et al., organizing and editorial committee co chairmen, pp. 325–341.

Jorgensen, F. R. A., "Investigation Of Shaft Reactions In Nickel Flash Smelting At 0.5 Kg $min^{-1}$ Scale," Pyrometallurgy, '87, papers presented at the Pyrometallurgy '87 symposium, London England, Sep. 1987, The Institute Of Mining And Metallurgy, pp. 627–645.

Kimura, T., et al., "Reaction Mechanism In A Flash Smelting Reaction Shaft," The Reinhardt Schuhmann International Symposium On Innovative Technology And Reactor Design In Extraction Metallurgy, held at the TMS–AIME Fall Meeting for Extractive And Process Metallurgy, Colorado Springs, Colo., Nov. 1986, Gaskell, D. R., et al., editors, published by the Metallurgical Society, Inc., pp. 403–418.

Themelis, N. J., et al., "Rate Phenomena In The Outokumpu Flash Smelting Reaction Shaft," Physical (List continued on next page.)

OTHER PUBLICATIONS

Chemistry Of Extractive Metallurgy, Proceedings of an international symposium sponsored by the Physical Chemistry Committee and the Copper, Nickel, Cobalt and Precious Metals Committee of the Metallurgical Society of AIME held at the AIME Annual Meeting, New York, N.Y., Feb., 1985, Kudryk, V., et al., editors, pp. 289–309.

Denholm, W. T., et al., "Sirosmelt Investigations, An Example Of Process Evaluation Techniques," The Aus-.I.M.M. North Queensland Branch, Smelting And Refining Operators Symposium, May 1985, pp. 141–153.

Conochie, D. S., et al., "Model Studies Of The Sirosmelt Gas Injection Lance," AIME Annual Meeting, Feb. 1984, 26 pages.

Brimacombe, J. K. et al., "Toward A Basic Understanding Of Injection Phenomena In The Copper Converter," Physical Chemistry Of Extractive Metallurgy, Proceedings of an international symposium sponsored by the Physical Chemistry Committee and the Copper, Nickel, Cobalt and Precious Metals Committee of the Metallurgical Society of AIME held at the AIME Annual Meeting, New York, N.Y., Feb. 1985, Kudryk, V., et al., editors, pp. 327–351.

Gray, N. B., et al., "Investigation And Modelling Of Gas Injection And Mixing In Molten Liquid Processes," Extractive Metallurgy Symposium, Melbourne Branch, Nov. 1984, Melbourne, Vic., Australia, published by the Australasian Institute Of Mining And Metallurgy, Australia, pp. 269–277.

Nilmani, M., Engh, T. A., Gray, N. B., Floyd, J. M., "Plant And Laboratory Investigations On Injection And Related Phenomena In Some Smelting And Refining Processes".

Coulter, M. D., Fountain, C. R., "The Isasmelt Process For Copper Smelting," 9 pages.

"Operation Of The Mitsubishi Process," pp. 51–76.

PYROMETALLURGICAL PROCESS FOR TREATING A FEED MATERIAL

This application is a continuation of U.S. Ser. No. 07/914,883, filed Jul. 16, 1992, now abandoned, which is a continuation of U.S. Ser. No. 07/766,007, filed Sep. 26, 1991, now abandoned.

BACKGROUND OF THE INVENTION

This invention relates to a pyrometallurgical process for treating a feed material.

High temperature smelting processes are examples of pyrometallurgical processes. Such processes are often carried out in two vessels, the one vessel being used to heat the feedstock (feed material) and thereby melt it, and the second vessel being used to oxidise the molten feedstock. The use of two vessels carries with it several disadvantages, one of which is the difficulty of transferring molten feedstock from one vessel to the other.

Lances have been developed in Australia which enable fuel and oxidising gas to be introduced into feedstock for a smelting process. A typical lance of this type is described in Australian Patent No. 520351 and consists of an outer tube and an inner tube. Liquid fuel for the process passes down the inner tube and exits through a nozzle into a mixing zone. In the case of the solid fuel lance, there is no nozzle. Oxidising gas passes along the passage defined between the inner and outer tubes and into the mixing zone. The oxidising gas acts as a coolant for the outer tube. The cooling effect of this gas on the outer tube allows slag or other material which is splashed on to this tube from the molten mass to freeze and so insulate and protect the tube. With the use of this technology, more than one lance is necessary for the melting and oxidation or reduction of the feedstock. These operations can all take place in a single vessel. Further, the use of such a lance produces a jet of fuel/oxidising gas with a result that the molten feedstock is vigorously, and even violently, agitated.

The process described above using the lance of Australian Patent No. 520351 is an "in-bath" process in that the feed material is digested and partially oxidised in the slag which is in a state of high turbulence effected by the injection, at high speed, of oxidising gas from the lance. An "in-flight" process is also known in which feed material in a dry and finely particulate form is combusted in a stream of oxygen-enriched air in a vertical shaft. The products of combustion fall on to a molten bath below where slag and matte fractions separate. Such "in-flight" processes are carried out in large furnaces which are expensive to produce and to operate.

SUMMARY OF THE INVENTION

According to the present invention, there is provided a process of pyrometallurgically treating a feed material which includes the steps of:

(a) producing a liquid body of feed material;

(b) creating a first reaction zone and a second reaction zone which is in contact with the first reaction zone and is in the liquid body;

(c) introducing feed material in particulate form and an oxidising gas into the first reaction zone;

(d) allowing in-flight oxidation of feed material to take place in the first reaction zone;

(e) allowing at least some of the reaction products of the in-flight oxidation to pass into a second reaction zone; and (f) allowing sulphidation or reduction of the reactant products to take place in the second reaction zone.

The invention provides, according to another aspect, a lance for use in introducing reactants, feed material and/or fuel to a vessel for carrying out a pyrometallurgical process wherein the lance has a discharge end which is characterised by an outer passage for delivering an oxidising gas, and an inner passage for delivering reactants or feed material for the process in a solid, liquid or gaseous form, or a mixture thereof, and optionally an intermediate passage located between the inner and outer passages for delivering fuel, the discharge outlet of the intermediate passage being such as to produce a diverging flow of fuel which is discharged therefrom.

DESCRIPTION OF EMBODIMENTS

The process of the invention is a pyrometallurgical one in which a feed material is subjected to an in-flight oxidation step and at least some of the reaction products of this in-flight oxidation pass into the second reaction zone where they are subjected to sulphidation or reduction. The second reaction zone is located in the liquid body of feed material.

The feed materials which may be treated in this process may be ores or concentrates of various compositions. For example, the ore or concentrate may be a sulphide such as chalcopyrite, pyrrhotite, pyroxene and feldspar. With the use of such ores or concentrates, a slag phase and a matte phase will form in the liquid body of feed material. With such feed materials resulphidation of oxidised products produced in the first reaction zone takes place in the second reaction zone.

The feed material may also be an oxide such as zinc or lead oxide. Such oxides may take the form of an ore, flue dust or a concentrate. Oxidation of some of the components of such a feed material will occur in the first reaction zone and reduction of some of the oxidised product so produced and other oxides will occur in the second reaction zone. Slag and matte phases will also form in the liquid body of feed material.

Where the molten bath contains a slag phase and a matte phase, the second reaction zone may be created in the slag phase only. Thus, in this form of the invention the reactions which occur in the second reaction zone are, in effect, "in-slag" reactions.

The feed material and oxidising gas are preferably introduced into the first reaction zone through the discharge end of a lance which comprises an inner passage through which the feed material passes and an outer passage surrounding the central passage and through which the oxidising gas passes. The inner passage and its discharge end must be of such a cross-section as to allow for the passage of particulate feed material therethrough. Typically, this feed material will have a particle size not exceeding 100 microns, although larger particle sizes can be used. Solid, particulate fuel such as coal or anthracite, may be mixed with the particulate feed material. Flues may also be included in this feed material. The inner passage is preferably circular in cross-section with the outer passage providing an annulus surrounding the inner passage.

The discharge end of the lance may be placed above the molten bath or in the molten bath. When the discharge end of the lance is placed in the molten bath, the oxidising gas will form a depression in the bath which defines at least part of the boundary of the first reaction zone. To achieve this, the oxidising gas will typically leave the lance at a velocity not exceeding 100 meters per second, preferably at a velocity of between 50 and 70 meters per second.

Figure 1:
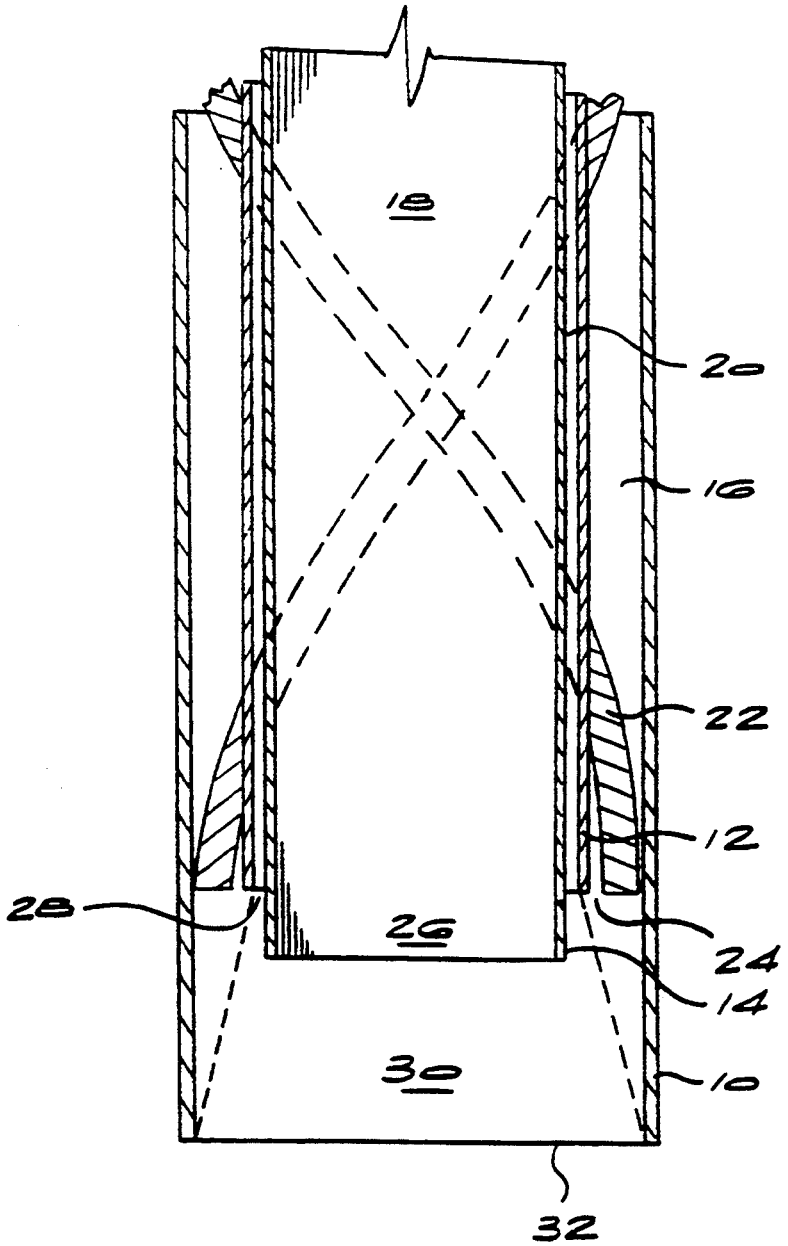
FIG. 1 illustrates a sectional side view of the discharge end of a lance for use in a pyrometallurgical process of the invention.

FIG. 1 illustrates an embodiment of a lance which can be used in the process of the invention. Referring to this figure, there is shown the discharge end of a lance comprising three concentric tubes 10, 12 and 14 of different diameters. Tube 12 is located inside of tube 10 and tube 14 is located inside of tube 12. The tubes are typically made of mild steel, although a portion extending immediately behind end 32 which is typically submerged in the molten bath may be made of stainless steel construction.

Three passages are defined between the tubes. There is an outer passage 16 defined between the tubes 10 and 12; there is an inner passage 18 defined within the tube 14; and there is an intermediate passage 20 defined between the tubes 12 and 14.

Flow swirlers 22 capable of creating turbulence in a gas flow are provided in the passage 16. These swirlers are secured to the outer surface of tube 12.

The passages 16, 18 and 20 have discharge outlets 24, 26 and 28 respectively, which open into a mixing zone 30.

The lance as illustrated by the drawing may be used for introducing feed material, fuel and oxidising gas into a vessel for a smelting or other pyrometallurgical process. The oxidising gas passes down the passage 16, the feedstock mixed with oxidising gas passes down the passage 18 and the fuel passes down the passage 20. The discharge outlet 28 of the passage 20 is very narrow, typically about 0,5 mm in width, so that when the fuel is delivered at a suitable pressure down the passage 20 it is discharged through the outlet 28 in the form of a diverging cone, as illustrated by the dotted lines. The rapid flow imparted to the fuel, due to the narrow passage also prevents its overheating, hence cracking. The outlet thus serves as a ring nozzle creating an intimate mixture of the fuel with the oxidising gas which is discharged from the outlet 24 leading to increased fuel efficiency.

In use, feed material in particulate form will be introduced into a smelting vessel. The lance will be so located in this vessel that the end 32 is just above the material. Fuel is delivered down the passage 20 and oxidising gas down the passage 16. Mixing takes place in the zone 30 and the mixture of gases is then ignited. The heat produced causes the particulate feed material to melt and create a progressively increasing liquid body or molten bath of the feed material in the vessel. Some of the molten material will splash on to the lance. This molten material will freeze on the outer surface of the tube 10 which is cooled by the oxidising gas passing down the passage 16. Cooling is enhanced by the action of the swirlers on the flow of oxidising gas. This frozen material acts as an insulant and protects the tube 10.

Figure 2:
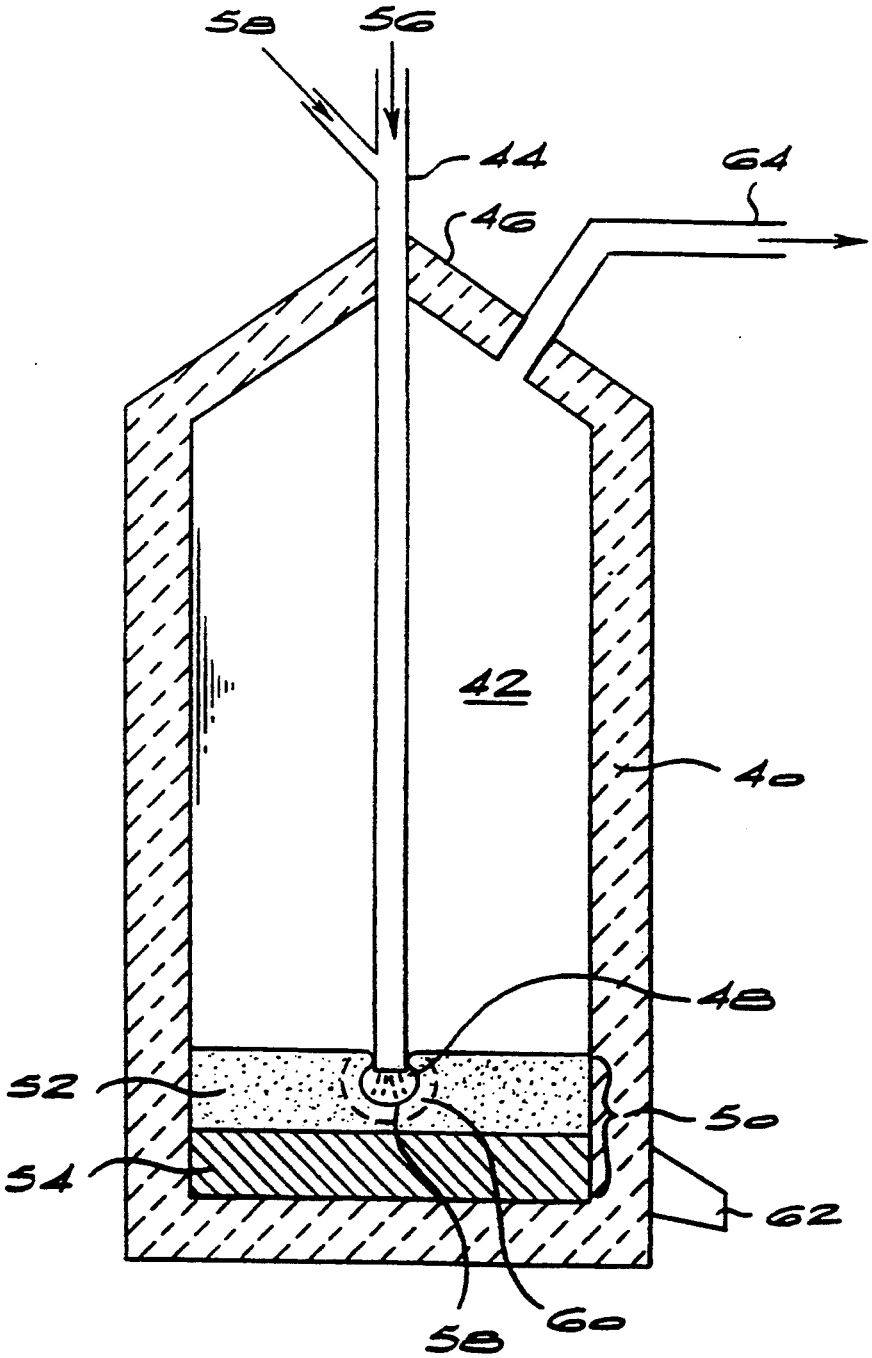
FIG. 2 illustrates a sectional side view of a furnace in which a pyrometallurgical process of the invention may be carried out.

Once the molten bath has been established to a satisfactory extent, the lance can be lowered so that the end 32 of the lance is located in the molten bath. This Is illustrated by FIG. 2 of the accompanying drawings. Referring to this figure, the reaction vessel 40 is a refractory lined furnace which contains a reaction volume 42 within it. The lance 44 passes through the top 46 of the vessel 40 and extends into the reaction volume so that the discharge end 48 (32 in FIG. 1) extends into the molten bath 50 of the feed material. The molten bath 50 consists of two phases—a slag phase 52 and a matte phase 54. Feed material is introduced into the lance at 56 and oxidising gas at 58. The feed material passes down the inner passage of the lance and the oxidising gas down the outer passage of the lance, as described above with reference to FIG. 1. When smelting certain sulphidic concentrates, it is not necessary at this stage of the process to use any fuel, as sufficient heat is generated by the oxidisation reactions to maintain the required temperature.

The oxidising gas leaves the discharge end 48 of the lance at such velocity that a depression 58 is produced in the slag phase 52. This depression 58 defines a first reaction zone in which feed material which leaves the discharge end 48 of the lance is subjected to in-flight oxidation. Excellent oxidation rates are achieved in this zone. A region or zone 60, illustrated by dotted lines, is created within the slag phase 52. This zone is one of turbulence and defines a second reaction zone in which oxidised reaction products and other oxides from the first reaction zone 58 are subjected to re-sulphidation or reduction, depending on the nature of the feed material. Thus, there is an in-flight oxidation which takes place in the zone 58 and an in-slag re-sulphidation or reduction which takes place in the molten bath in the zone 60.

The products of the re-sulphidation or reduction pass downwards through the slag phase 52 and into the matte phase 54. The slag and matte phases may be tapped from time to time through outlet 62. Outlet 64 is used for exhausting gases such as sulphur dioxide which are produced in the process.

FIG. 2 illustrates an embodiment in which the discharge end of the lance is located in the slag phase of the molten bath. The process can also operate with this discharge end immediately above the molten bath. In this case, the first zone will be defined between the discharge end 48 of the lance and the surface of the depression which is formed in the slag phase. However, under these conditions, higher dust losses will occur.

It is to be noted that the creation of two zones where different reactions take place does not occur in a smelting process using a lance of the type described in Australian Patent No. 520351. With the use of such a lance, a jet of gas and/or fuel leaves the lance creating a high degree of turbulence in the molten bath. Feed material is not delivered through the lance and so there is no in-flight oxidation. In the present invention, smelting is more efficient in that higher reaction rates are achieved and the use of a finely particulate feed material means there is no undigested material suspended in the slag. Further, there is significant turbulence only in the zone 60 leading to lower refractory wear rates. Finally, penetration of the oxidising gas into the matte phase can be controlled better as the lance discharge end can be situated further above the matte phase than is possible with the lance of the Australian patent.

The flow rates, pressures and particle sizes of feed material will vary according to the nature of the materials used. Examples of typical flow rates, pressures and particle sizes are:

1. Mass flowrate of feed material (including flux and coal): 50 to 200 kg/hr at air pressures up to 200 kPa (gauge).
2. Volume flowrate of lance oxygen-enriched air : 50 to 200 $Nm^3/hr$ at pressures up to 200 kPa (gauge).
3. Volume flowrate of air transporting the solids (in (1) above): 20 to 50 $Nm^3/hr$.
4. Volume flowrate of diesel: 5 to 15 liters/hr at 20° C. up to 700 kPa,
5. Particle sizes of:
   Sulphide concentrate: 70 to 80% minus 74 micrometers.
   Fluxes (either silica or burnt lime): 70 to 80% minus 74 micrometers.
   Coal or anthracite: 80 to 90% minus 74 micrometers.

The invention will now be further illustrated by the following examples of smelting processes carried out using a lance and furnace as described above and illustrated by FIGS. 1 and 2.

1. EXAMPLE OF A TYPICAL COPPER/NICKEL SULPHIDE SMELTING OPERATION

Heating of the furnace is obtained by combustion. During start-up a small amount of LPG gas is injected via the lance for preheating the furnace. As soon as the furnace hearth is at 700° C., the gas is replaced with diesel and the furnace is heated up to operating temperature (1350° C.) with oxygen enriching the air. The average diesel flowrate used is 10 l/h at a pressure of 680 kPa, The average oxygen enrichment is 10 $Nm^3/h$ during the pre-heating cycle. Once the operating temperature is achieved, a pneumatic feed system is activated and controlled amounts of particulate concentrate and flux are fed pneumatically via a flexible hose to the passage 18 of the lance and into the furnace. The pneumatic feeding system is operated at an air pressure of 150 kPa and an air flowrate of 20–40 $Nm^3/h$, depending on the flux and concentrate mixture. A depression or first reaction zone 58 is formed in the molten bath. In this zone, in-flight oxidation of the sulphides in the concentrate takes place. The products of this reaction, namely a mixture of base metal oxides and sulphides then enter the slag phase (zone 60) whereupon further reactions between the base metal oxides and finely dispersed molten matte globules take place. As a result of the intense agitation in the zone 60, the reactions occur rapidly and equilibrium is quickly reached, which results in a very short retention time. The $SO_2$ in the off gas is monitored for acid production, and is maintained at a concentration of between 5 and 15%, after cooling air has been introduced.

A liquid matte containing about 20% iron and a liquid slag containing the gangue material and flux are formed. It is also possible to reduce the iron level in the matte to any desired level, thereby minimising the need for a subsequent converting operation.

Before tapping, concentrate feeding is terminated, the lance is raised 0,5 m to 1 m from the furnace hearth to allow the bath to settle and so minimise matte entrainment in the slag. The furnace is tapped by oxygen lancing the taphole open, the matte and slag are tapped into cast iron bogeys, cooled, separated, weighed and sampled for chemical analyses.

In this example, oxidation in the in-flight zone takes place on the surfaces of the various sulphide particle types whereupon a range of oxides are produced. The reactions are:

$$3FeS+5O_2 \rightarrow Fe_3O_4+3SO_2$$

$$0.5(Ni,Fe)_9S_8+6.87O_2 \rightarrow 1.125NiFe_2O_4+1.125NiO+4SO_2$$

$$CuFeS_2+3O_2 \rightarrow 0.5Cu_2O.Fe_2O_3+2SO_2$$

Because these reactions are highly exothermic, it is possible for particle temperatures to exceed well beyond 1500° C. with the result that the sulphide situated below the particle surface undergoing oxidation dissociates and melts, an example being:

$$CuFeS_{2(s)} \rightarrow 0.5Cu_2S_{(1)}+FeS_{(1)}+0.25S_{2(g)}$$

where the subscripts in parentheses, namely s, 1 and g, mean solid, liquid and gas respectively. In this way a molten bleb of Cu-Fe-S is formed. Similarly, molten blebs of Fe-S and Ni-Fe-S are formed with the other sulphide types present in the sulphide concentrate.

The products of the reactions taking place in the in-flight zone are therefore a range of oxides and molten sulphides. On entering the slag, in-slag reactions take place where the FeS component of the molten sulphide blebs reacts with the iron, nickel and copper oxides resulting in the reduction of trivalent iron ions to the divalent state as well as the resulphidation of the nickel and copper oxides. Some of the reactions are:

$$FeS+3Fe_3O_4 \rightarrow 10FeO+SO_2$$

and $$FeS+Cu_2O \rightarrow Cu_2S+FeO$$

These reactions are promoted by the presence of silica, which is included in the sulphide concentrate, which promotes the in-slag reactions because of the favourability of the reaction:

$$2FeO+SiO_2 \rightarrow Fe_2SiO_4$$

where fayalite ($Fe_2SiO_4$) is the product.

2. EXAMPLE OF THE USE OF THE LANCE FOR THE TREATMENT OF STIBNITE CONCENTRATE AND ARSENIC MIDDLINGS MATERIAL

To facilitate safe and efficient furnace start-up the diesel fuel supply of the lance is temporarily replaced by butane (LP gas). The gas is ignited and the lance lowered onto a bed of coke on the furnace bottom. Once the coke is red hot the diesel replaces the LP gas and the furnace is then heated to approximately 1200° C. by means of the diesel with oxygen enrichment, It is important to have cooling air flowing through the outer passage 16 of the lance at all times. An air flow of 100 to 130 $Nm^3/h$ is used at a pressure of 120 kPa. A diesel flow in the passage 20 of 5 to 15 l/h is used at a pressure of 680 kPa.

Once the furnace is at 1200° C. the feeder vessel is pressurised to 150 kPa, the rotary vane feeder is started and pneumatic feeding commences. If stibnite concentrate is processed, the stibnite entering the hot furnace at the tip of the lance along passage 18 immediately reacts with the oxygen to form volatile crude antimony oxide, which is removed, condensed and collected in a baghouse. The impurities in the concentrate, approximately 15%, smelt down to form a slag bath. A small proportion of the antimony will dissolve in the molten slag as antimony oxide. Since about 85% of the feed material is volatile, the furnace vessel will take a long time to fill up. Once the furnace is filled to about 0,5 m, a reduction step in which the antimony oxide is reduced to the metal is carried out by adding about 20 kg of coke over a 20 minute period.

The lance should be raised about five minutes before tapping to allow bath to settle and so prevent metal entrainment in the slag. The furnace is tapped by oxygen lancing the taphole open. The slag and metal bullion are tapped into cast iron bogeys, cooled, separated, weighed and sampled for chemical analyses.

If arsenic middling material is treated, the process is similar to that of the stibnite concentrate. The only difference being that more gangue material is present and much more slag is formed.

We claim:

1. A process of pyrometallurgically treating a feed material which includes the steps of:

(a) producing a liquid body of feed material;

(b) creating a first reaction zone and a second reaction zone which is in contact with the first reaction zone and is in the liquid body, the first reaction zone being created by placing the discharge end of a lance in, or immediately above, the liquid body and causing oxidising gas to leave the discharge end at such velocity that a depression defining the first reaction zone is formed in the liquid body;

(c) introducing into the first reaction zone feed material in particulate form, fuel and oxidising gas;

(d) allowing in-flight oxidation of feed material to take place in the first reaction zone;

(e) allowing at least some of the reaction products of the in-flight oxidation to pass into a second reaction zone; and (f) allowing sulphidation or reduction of the reaction products to take place in the second reaction zone.

2. A process according to claim 1 wherein the feed material is a sulphide ore or concentrate.

3. A process according to claim 1 wherein the feed material comprises an oxide or a mixture of oxides.

4. A process according to claim 1 wherein the liquid in the second reaction zone is in a state of turbulence.

5. A process according to claim 1 wherein the particulate feed material has an average particle size not exceeding 100 microns.

6. A process according to claim 1 wherein the oxidising gas is selected from oxygen, oxygen-enriched air and air.

7. A process according to claim 1 wherein the molten bath contains a slag phase and a matte phase and the second reaction zone is created in the slag phase only.

8. A process according to claim 1 wherein the feed material and oxidising gas are introduced into the first reaction zone through the discharge end of a lance comprising an inner passage through which the feed material passes and an outer passage surrounding the inner passage and through which the oxidising gas passes.

9. A process according to claim 8 wherein the inner passage is circular in cross-section and the outer passage provides an annulus surrounding the inner passage.

10. A process according to claim 8 wherein the discharge end of the lance is placed in the molten bath and the oxidising gas forms a depression in the bath which defines at least part of the boundary of the first reaction zone.

11. A process according to claim 8 wherein the oxidising gas leaves the lance at a velocity not exceeding 100 meters per second.

12. A process according to claim 8 wherein the oxidising gas leaves the lance at a velocity of between 50 and 70 meters per second.

13. A process according to claim 8 wherein an intermediate passage is provided between the inner and outer passages and the intermediate passage is used for delivering fuel, the discharge end of the passage being such as to produce a diverging flow of fuel which is discharged therefrom.

14. A process according to claim 8 wherein the outer passage is provided with formations adapted to create turbulence in the flow of gas passing along the passage.

* * * * *